US007207747B1

(12) United States Patent
England

(10) Patent No.: US 7,207,747 B1
(45) Date of Patent: Apr. 24, 2007

(54) DRAINAGE SYSTEM FOR SAND BUNKER

(75) Inventor: Andrew J. England, Chester, CT (US)

(73) Assignee: Infiltrator Systems Inc, Old Saybrook, CT (US)

( * ) Notice: Subject to any disclaimer, the term of this patent is extended or adjusted under 35 U.S.C. 154(b) by 791 days.

(21) Appl. No.: 10/012,122

(22) Filed: Nov. 13, 2001

(51) Int. Cl.
*E02B 11/00* (2006.01)

(52) U.S. Cl. ..... 405/43; 405/49; 210/170.01; 210/170.03

(58) Field of Classification Search ..... 405/43, 405/45, 46, 49, 50; 210/170.01, 170.03
See application file for complete search history.

(56) References Cited

U.S. PATENT DOCUMENTS

| | | | | |
|---|---|---|---|---|
| 3,976,578 | A | 8/1976 | Beane | 210/484 |
| 4,182,581 | A | 1/1980 | Uehara et al. | 405/43 |
| 4,909,665 | A | 3/1990 | Caouette | 405/45 |
| 4,960,345 | A | 10/1990 | Hurley et al. | 405/38 |
| 5,511,903 | A | 4/1996 | Nichols et al. | 405/43 |
| 5,752,784 | A | 5/1998 | Motz et al. | 405/43 |
| 5,823,711 | A | 10/1998 | Herd et al. | 405/36 |
| 5,839,844 | A | 11/1998 | Nichols et al. | 405/43 |
| 5,890,838 | A | 4/1999 | Moore, Jr. et al. | 405/49 |
| 5,954,451 | A | 9/1999 | Presby | 405/49 |
| 6,076,992 | A * | 6/2000 | Fukui et al. | 405/43 |
| 6,361,248 | B1 * | 3/2002 | Maestro | 405/49 |

OTHER PUBLICATIONS

"Introducing the New EZ*flow* Dewatering System", EZ*flow* L.P., (2) Page Brochure, unknown date.

"On Site Septic Systems", Advanced Drainage Systems, Inc (2) Page Web Site Printout (1998).

"Advanedge® Pipe", Advanced Drainage Systems, Inc. (3) Page Web Site Printout (1998).

"A Double-Barreled Solution . . . ", Advanced Drainage Systems, Inc, Brochure, (7) Pages, unknown date.

"SB2", Advanced Drainage Systems Inc, (8) Page Brochure (1979).

Mirafi® N-Series NonWoven Polypropylene Geotextiles, (2) Page Technical Data Sheet, unknown date.

(Continued)

*Primary Examiner*—Tara L Mayo
(74) *Attorney, Agent, or Firm*—C Nessler

(57) ABSTRACT

Rain water is drained from a golf course sand bunker or like structure by a drainage system which comprises a conduit having a solid top and perforations in the sidewall. A conduit which is a chamber having an arch shape cross section is contained within a sand filled trench running along the bottom of a bunker. Water flows downwardly from the bunker into the trench, passing through opposing side trapezoid cross section spaces which are defined between the outwardly angled chamber sidewalls and the essentially vertical trench sidewalls. The water then flows horizontally into the conduit. Geotextile, in combination with downward sloping louvers which define slot perforations in the chamber sidewalls, hinders flow of sand into the interior of the chamber. The arch shape of the preferred conduit frees the trench bottom of vertical soil-compressive load and enables it to be fully exposed for water penetration. An endplate at the end of a string of chambers has an elevated outlet that causes water which flows into the chamber to be retained until it reaches a predetermined level.

25 Claims, 7 Drawing Sheets

OTHER PUBLICATIONS

"Bunker Construction Techniques" B. M. Silva, Golf Course Management, (2) Pages, (1986).
"Stop Bunker Face Erosion", B. Maloy, USGA Green Section Record, (1) Page (1999).
"Bunkers: The Right Track", P. M'Obrien, USGA Green Section Record (1) page (1999).
"ADS Engineered Turf Drainage", Advanced Drainage Systems Inc, (12) Page Brochure, (1999).

* cited by examiner

DRAINAGE SYSTEM FOR SAND BUNKER

TECHNICAL FIELD

The present invention relates to subsurface drainage systems, particularly drainage systems for use with artificially constructed earthworks such as sand bunkers on golf courses.

BACKGROUND

Sand bunkers, also called sand traps, are sandy depressions which are interspersed along a golf course, typically in vicinity of the putting green and hole. They are intended to impede the motion of a golf ball which flies or rolls into them, but at the same time to enable a golfer to hit such a ball while it lies on the surface. Sand bunkers are located according to the design of the golf course architect. Their placement and configuration is in part limited by the geography of the other natural and man made features of the course. While sand bunkers are configured and placed to present a challenge to the golfer, they also have an esthetic aspect—presenting a pleasing appearance, by themselves and as part of the whole of the golf course.

Since sand bunkers are often placed on slopes, and often themselves have slopes, there is a tendency over time for the sand to move to about in the bunker under influence of such as wind, gravity, rain and golfers. Also, the sand can become contaminated with soil and debris. Thus, bunkers must be maintained by the golf course personnel for functionality and appearance. Often times, this means running rakes across the surface to redistribute and smooth the sand and to remove debris.

It is desirable that a golf course as a whole, and any bunker in particular, present consistent difficulty to players over time and under varying weather. That aim is defeated if water accumulates in the sand of the bunker because the character of the sand is changed by excessive wetness. Thus, when bunkers do not have self-draining shapes, or are situated on soils which do not have good permeability to water, then a drainage system is often installed.

In familiar types of bunker drainage systems, there is a trench within the soil beneath the depression into which bunker sand is placed. Usually a perforated conduit or pipe runs through stone or coarse gravel which fills the trench, to a discharge point away from the bunker.

Sometimes the sand of the bunker fills the trench and surrounds the pipe. Other times, the trench contains sand. A filter fabric called geotextile is usually placed on top of the gravel or stone, to prevent sand from entering and clogging the gravel or stone. Likewise, if a perforated pipe is surrounded by sand, the pipe is circumscribed with geotextile, to prevent sand from entering the openings in the pipe. In another variation, a perforated pipe is circumscribed by a layer of closed cell plastic foam pellets, which layer in turn is circumscribed in part or whole by geotextile and by granular media within the trench.

One of the problems with any system that uses geotextile is that the fabric can be snagged and torn by manual or powered rakes which are used for bunker maintenance, and the system will then fail in its intended function. Drainage systems which comprise pipes having relatively small openings are prone to filter fabric clogging when it is attempted to keep fine particles from entering the drains. On the other hand, if a coarse geotextile is used, then too much sand can flow into the drain, the piping can become clogged or the bunker depleted.

In some situations, it is an aim to store the water which flows into the drain beneath the surface of the earth, so it can either then dissipate it into the soil over time or be pumped out over time. However, providing sufficient size of underground reservoirs can be costly. And it can be a problem if the capacity of the reservoir is exceeded, if the drain then fails to function.

While the prior art systems are effective for their intended purpose in many instances, improvements are always sought in terms of drainage system cost (including transport and installation), durability and lowered maintenance.

SUMMARY

An object of the invention is to provide an improved drainage system for sand bunkers of golf courses and for other accumulations of granular materials. A further object is to provide a drainage system which has improved storage capacity and capability for infiltrating accumulated water into the earth. A further object is to have a drainage system which is less prone to failure due to maintenance work, particularly raking. A further object is to provide a drainage system which is less prone to failure due to failure of geotextile.

In accord with the invention, a drainage system for a sand bunker comprises a depression in the soil filled with sand within which runs a conduit having a top which is solid, or free of perforations. The conduit has perforations further down the sides of the conduit. Thus, all the water which flows into the bunker, to enter the conduit, flows first downwardly past the top of the conduit, and then horizontally to enter the conduit interior. Preferably, there is a trench at the bottom of the depression in which the conduit rungs, and the conduit is shaped as a chamber having an arch shaped cross section and perforated sidewalls running downwardly from the top to opposing side bases. The conduit sidewall perforations are preferably downward sloping louvers, to obtain the desired water flow pattern.

Preferably, the arch shape conduits are in a trench and a geotextile runs along perforated portion of the side wall. In a preferred embodiment, the geotextile runs all around the conduit, including under the conduit. The preferred method of placing geotextile is to first place it in a trench; then, the conduit is then placed in the trench; then, the geotextile is folded over the conduit; and, then the trench is then filled with sand.

In accord with the invention, a conduit is contained within a trench, and when viewed in cross section there are inwardly and downwardly trapezoid shape regions on each side of the conduit, between the conduit sidewalls and the essentially vertical trench side walls (which are within 30 degrees of perfectly vertical, or plumb). Preferably, the conduit sidewalls have an inward slope of 6–15 degrees from the vertical and the horizontal area of the top of the trapezoidal cross section region is less than the essentially vertical area of the trapezoidal zone which is adjacent the conduit sidewall.

In the invention, the arch shape of the conduits leaves the center part of the trench, between the sidewalls, open (unmasked) and uncompressed, promoting better infiltration into the soil. In a variation embodiment, the conduit rests on a layer of sand in the bottom of a trench cut in soil.

In further accord with the invention, an array of chambers has an endplate so that the amount of water which is stored in the array can be controlled according to the exit opening (invert) height in the endplate. Thus, when there is flow in excess of the capacity of the chamber array, discharge is conveniently made. At the same time the configuration of the system enables settling out within the chamber of fine grains of sand which may enter the chamber, so they are not discharged with the water.

The invention provides improved storage capacity and its configuration and the favorable geometry of the system mean there is less propensity for geotextile to fail and less propensity for sand to enter the chamber due to gravity or water flow. The system has greater storage volume per unit length. The greater surface area of openings and less average velocity of water give the system more capacity to absorb any given amount of fines of contaminant.

The foregoing and other objects, features and advantages of the present invention will become more apparent from the following description of preferred embodiments and accompanying drawings.

DESCRIPTION

Sand bunkers, also referred to as sand traps, as used on golf courses, commonly have irregular dimension and surface contour. They are usually formed by filling suitably shaped depressions in the native soil with a selected grade of sand to a depth of 4 inches or more. To suit the needs of the game of golf, the sand is selected for a multiplicity of characteristics, including that it will support without enveloping a golf ball which falls in the trap (thereby avoiding a "fried-egg" effect); that it will remain easily movable or deformable when it is hit by a golf club impacting a ball lying on the sand; that it will not cake nor take on a crusty surface; that it will drain readily; that it will not be contaminated with soil or vegetation; and that it will remain stable and in place over time. Of course, there is a contradiction in some of the desired characteristics and trade-offs are necessarily made.

A typical sand for a bunker is a natural silica material like that which is recommended by the United States Golf Association (USGA). It has the following size distribution by volume: Gravel (2–4 mm particle size), 3% or less; Very coarse sand (1–2 mm) including the gravel, no more than 7%; coarse sand (0.5–1 mm) in combination with medium sand (0.25–0.5 mm), 65% or more; fine sand (0.15–0.25 mm) in combination with very-fine sand, 25% or less; silt and clay, 3% or less.

The particle shape will vary with the source. Natural beach and river sands will tend to have rounded grains. Artificially fractured sands will have angular grains.

It is usually not acceptable, as a trade off, to have the sand become submerged in water or become very wet. Thus, a drainage system is used when the soil is not sufficiently permeable to water and when the contour of the bunker depression does not convey water to the edge and out of the bunker. With a drainage system, the surface of the bunker depression in the soil is contoured to bring water that falls onto the sand to one or more central locations where it is collected, to then be stored or to be drained away to a discharge point.

Figure 1:
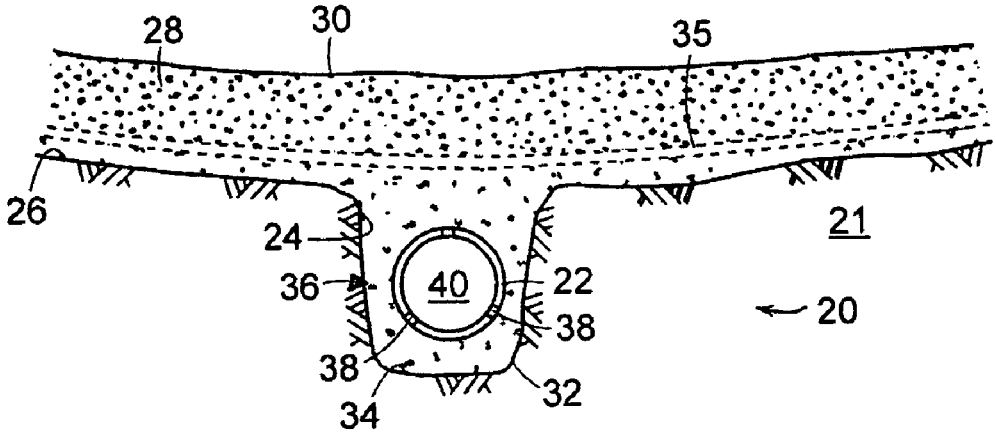
FIG. 1 PRIOR ART
FIG. 1 is a cross section elevation view of a prior art drainage system comprising a circular perforated pipe in a trench.

FIG. 1 shows in cross section elevation a typical prior art drainage system or drain 20 which is used in combination with a sand bunker which is comprised of sand 28 lying on the dished shape surface 26 of a depression scooped out of the soil of the earth. The drain 20 comprises a trench 36 having a bottom 34 and opposing sidewalls 24. The slope of the sidewalls is typically near vertical, but may be inclined outwardly from the trench centerline according to the cohesion of the soil. The trench contains a conduit, such as round cross section perforated pipe 22, buried within a granular material 32, such as gravel (>2–4 mm diameter particles) or pea stone (~10 mm particles) which fills the trench. A filter fabric or geotextile layer 35 keeps the sand 28 from flowing or migrating downwardly into the stone 32. Often, for convenience of construction, the geotextile is laid over the whole surface of the depression. The surface 26 of the soil under the bunker might be covered with a liner comprised of a sprayed plastic film, a filter fabric as described, or a proprietary drainage mat, such as an Enka™ mat, to stop erosion of the soil and or aid the flow of water underneath the sand mass toward the drain. Of course, all of those kinds of layers can be caught up and torn during raking.

Referring to FIG. 1, water falling on the surface 30 of the sand runs downwardly through the sand and toward the drain 20. It passes through the fabric layer 35, into the interstices of the stone or gravel mass 32. Some water flows directly downward into the perforations in the top of the pipe. Typically, in perforated pipes there are a multiplicity of perforations, not the few shown in the Figure. And, a hole pattern, such as the 120 arc degree spacing in the Figure, may rotate around the pipe circumference along its length. The stone or gravel surrounding the pipe will act as a reservoir or storage volume. In the typical prior art, the perforated pipe is 4 inch nominal diameter, and the trench is 6 inch wide by 8 inch deep.

Figure 2:
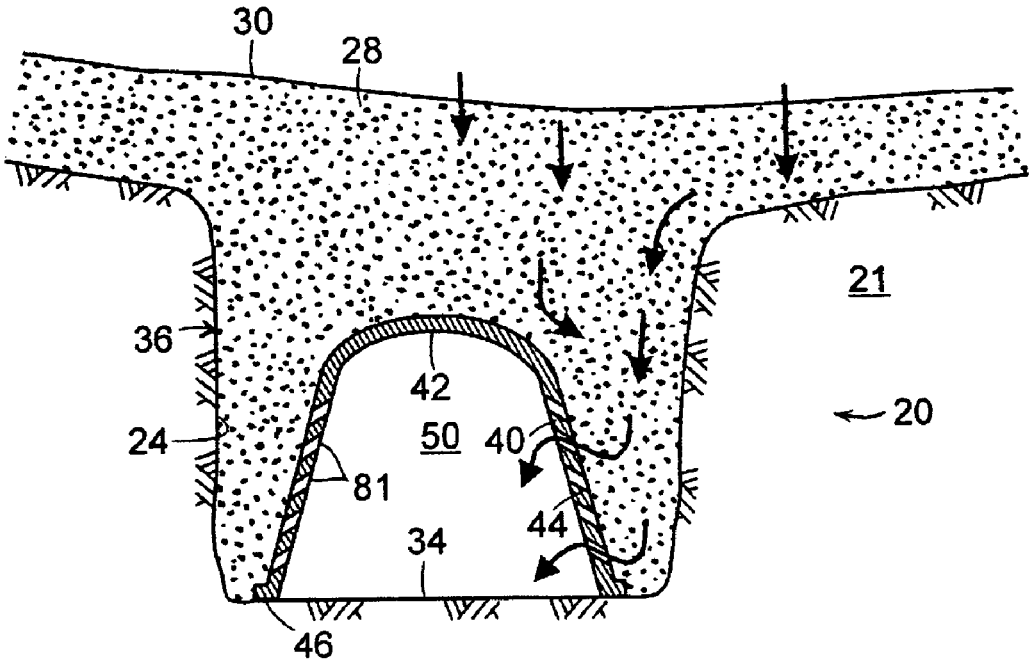
FIG. 2 is a cross section elevation view of an arch shape conduit in a trench running along the bottom of a sand bunker.

FIG. 2 shows in cross section elevation an embodiment of the invention. The drainage system 20 comprises trench 36 which has essentially vertical walls, characteristic of a trench dug by a common backhoe excavator in firm earth. Running lengthwise along the center of the trench is a conduit 40 having an arch shape cross section and open bottom. Such conduits often referred to as chambers. The chamber has a top 42 and opposing sidewalls 44 running downwardly and outwardly at an angle to opposing side base 46. The hollow space of the interior 50 of the chamber extends a preponderance of the distance from the bottom of the trench toward the top.

Figure 3:
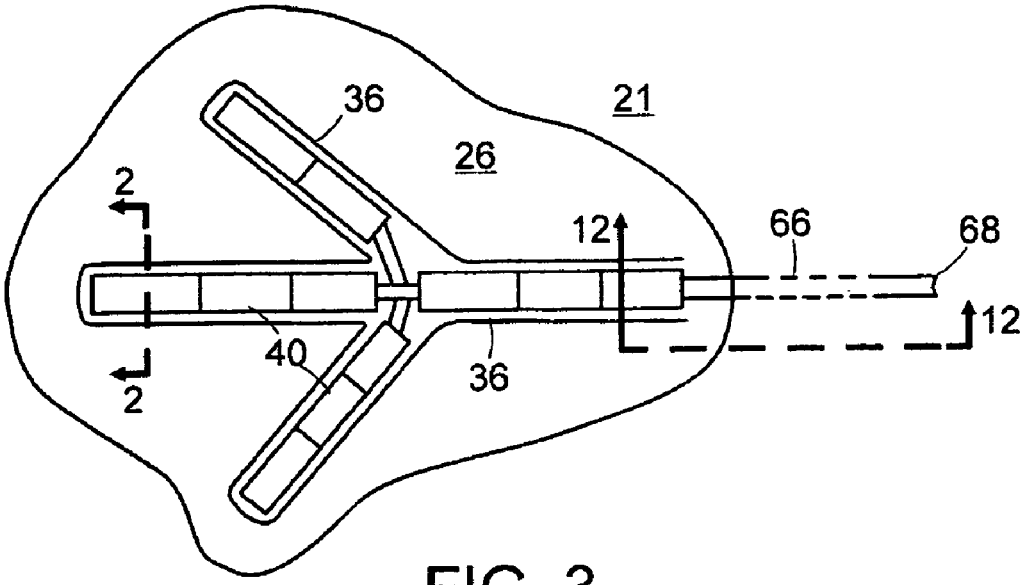
FIG. 3 is a top view of an array of conduits running along the bottom of a bunker.

Typically, the trench is long and a series of chambers are interconnected, often in herringbone patterns. FIG. 3 is a top view of a bunker without sand, showing trenches 36 having interconnected chambers 40 connected to a discharge pipe 66. Referring again to FIG. 2, when the bunker is filled with sand as are the spaces between the opposing chamber sidewalls and adjacent trench walls are filled. The sand preferably meets the aforementioned USGA recommendation. In an alternative, coarser media might be used in the spaces. The scale of FIG. 2 is nominally the same as that of FIG. 1 and thus the larger size of the chamber and associated trench can be seen, along with the geometric differences.

The preferred chamber 40 is comprised of a multiplicity of alternating peaks and valleys. the top is unperforated, or solid, by which is meant it is essentially impermeable to significant water flow. The sidewalls, including the webs which connect the peaks and valleys at the sidewalls, are perforated with slots 81; all as described in U.S. Pat. No. 5,511,903, the disclosure of which is hereby incorporated by reference. See also the side view of a portion of a chamber in FIG. 10 herein. In the generality of the invention, chamber sidewalls are water permeable. Other than the preferred slots, sidewalls may have other types of openings which permit water to permeate through, such as simple holes, porous screens, etc. Thus, the term perforated should be construed to comprehend any plurality of passages through which water can flow.

The chamber 40 as shown in FIG. 2 rests on the bottom 34 of the trench. The chamber 40 has spaced apart bases 46 at the lower the ends of the sidewalls. Typically, the chamber base comprises small flanges extending laterally from the sidewall lower ends and running there-along, to better distribute the load of the chamber on the supporting soil or sand. Atypically, chambers may have bottoms which span the space between the sidewalls. Typically chambers will be made from a injection molded polyolefin, predominantly high density polyethylene plastic, preferably the proprietary Polytuff™ plastic (Infiltrator Systems, Inc., Old Saybrook, Conn.).

An exemplary commercially available chamber is the Quickplay™ 46 Chamber (Infiltrator Systems, Inc.) The preferred Quickplay 46 chamber of the invention preferably has a relatively high aspect ratio of 0.73 to 1 (11 inch height to 15 inch base width) and sidewalls with slope of about 15 degrees from vertical. The perforated portion of the sidewall is comprised of slots 81 defined by downwardly sloped louvers, as described further below. The perforated portion of the sidewall extends upwardly to an elevation of about 9.3 inches from the base, so it comprises about 85% of the total chamber height of 11 inches. In the generality of the invention, the more preferred chambers will have an aspect ratio of 0.7 to 1 and sidewalls with a slope of 6–15 degrees. These and other preferred chambers have overall dimensions like those high aspect ratio chambers described in U.S. Pat. No. 5,890,838 to Moore et al., the disclosure of which is hereby incorporated by reference. See particularly Col. 4, lines 7–30 and FIG. 2. The cross section illustrations herein approximately represent a peak section of a Quickplay 46 chamber.

The arrows in FIG. 2 here illustrate how rain or other water which falls on the surface 30 of the bunker flows vertically and sideways in the bunker to the top of the trench, then downwardly into the trench and to vicinity of the chamber. Essentially none of the water passes vertically downwardly into the chamber, owing to the unperforated or solid top 42, although some insubstantial water may enter a chamber through inter-chamber joints or at other connections. After the water passes by the top, it then flows laterally through the sidewalls and into the chamber interior 50; whereupon it falls to the bottom of the chamber interior. According to the length and slope of the downward sloped louvers, the water may flow upwardly to a small extent, to enter the chamber. Likewise, water running down to the bottom of the trench may run laterally under the base of the chamber in part; or it may accumulate in the sand until it rises to a level where it runs laterally through the lower part of the sidewall.

The forced lateral flow, and absence of vertically down flow into any chamber openings, as would not be the case if there were openings in the top. The forced flow path hinders flow of fine sands into the chamber, or clogging of filter fabric at the openings. While the much preferred conduit is the arch shape cross section of the chamber, in the generality of the invention, the desired downward-then-horizontal flow can be achieved in a round conduit having an upper lengthwise semi-circular half free of perforations. Depending on the water flow and absorption by the soil 21, the water may collect as a pool at the bottom of the interior cavity.

Figure 4:
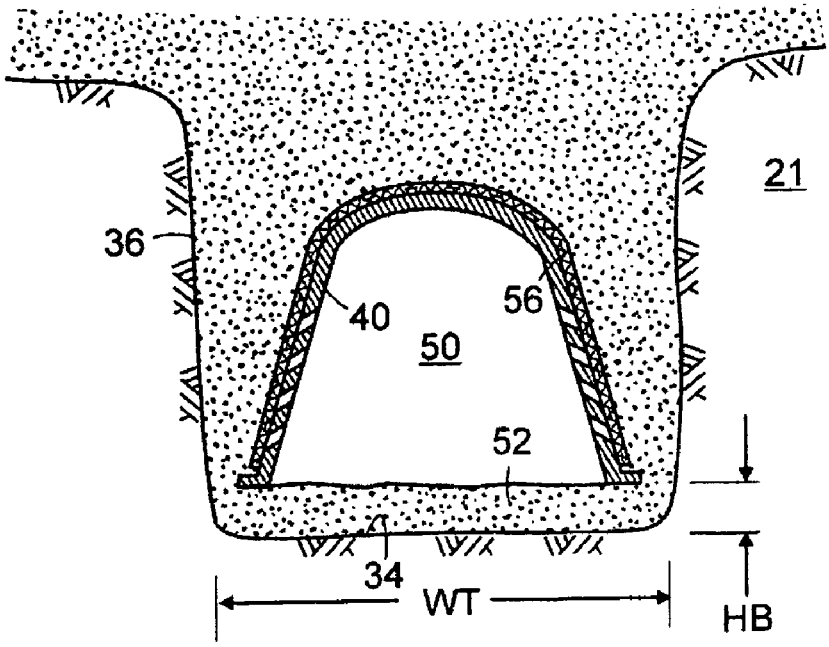
FIG. 4 is an end view like FIG. 2, showing geotextile on the conduit.

FIG. 4 is similar to FIG. 2 in showing a portion of another embodiment of a drainage system comprising a chamber type conduit in a trench. In FIG. 4 the chamber 40 has a layer 56 of filter fabric running along the sidewalls (and incidentally over the top), to prevent sand from entering the perforations of the sidewalls, as discussed further below. In contrast with the FIG. 2 embodiment, the chamber 40 in FIG. 4 rests on a layer of sand 52, having a thickness HB, typically 1–3 inches, and extending a distance WT across the width of the bottom 34 of the trench 36. The use of sand on the bottom of the trench is helpful in providing a more even base, particularly when the soil is especially uneven or rocky. For the aforementioned Quickplay 46 chamber, which is about 15 inch wide at the base, the dimension WT will be about 18 inch.

Figure 5:
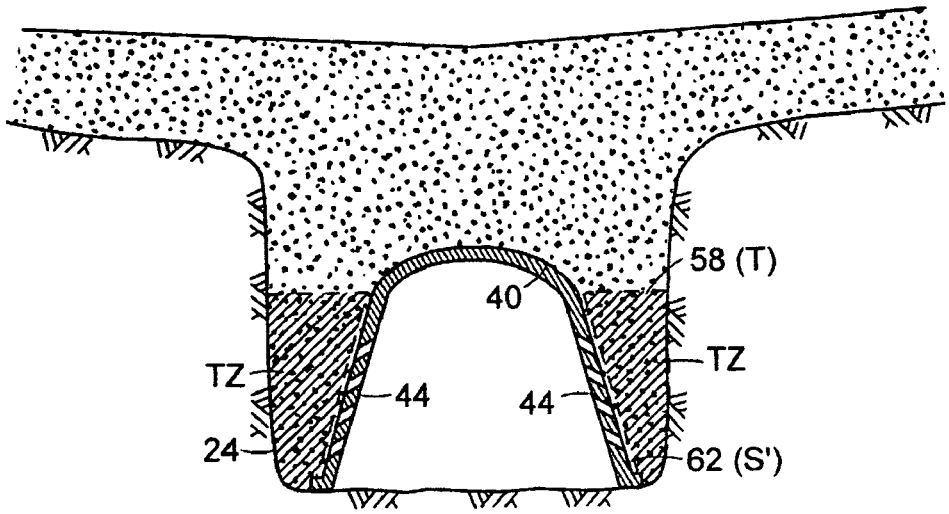
FIG. 5 is an end view like FIG. 2, showing the trapezoidial cross sections of the sand between the conduit and trench walls.

FIG. 5 is like FIG. 2 and shows certain geometrical relationships related to advantages which a drainage system having an arch shape cross section conduit provides over the prior art drainage systems having circular conduits as exemplified by FIG. 1. On each side of the chamber 40, between the sidewalls 44 of the chamber and the sidewalls 24 of the trench 36 is a nominally trapezoidal cross section zone TZ, where the trapezoid tapers inwardly in the downward direction. The upper bound 58 of the trapezoid has an elevation corresponding with the elevation of the bottom of the solid top, i.e., the top of the perforated portion of the sidewall of the chamber. The inner bound 62 of the trapezoid corresponds with the perforated portion of the sloping chamber sidewall but is spaced a small distance apart from it. When we consider the drainage system in FIG. 5 as having a unit length, the upper boundary 58 of zone TZ has an area designated as T, while the inner boundary 62 has an area designated as S.

For an exemplary Quickplay 46 chamber set in a trench which is nominally 18–19 inch wide the area S will be about 115 square inches while the area T will preferably be in the range of about 60–80 square inches, depending on the slopes of the chamber and trench sidewalls. Since the chamber has peaks and valleys, the dimension T will vary according to the point of reference along the chamber. (Valley sections are nominally congruent with peak sections and about 3 inch narrower at the base.) To the extent the trench has outward sloping walls, the dimension T will increase as discussed below, and to the extent the chamber has near vertical walls the dimension S will decrease.

Figure 6:
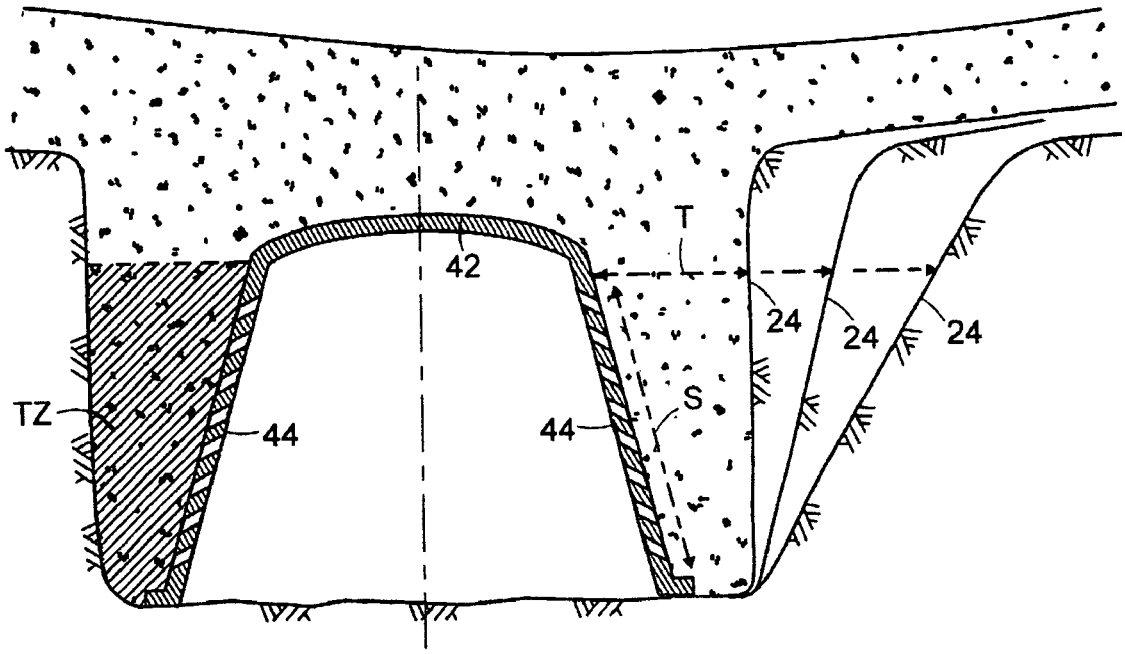
FIG. 6 is like FIG. 5, showing different essentially vertical trench side walls.
Figure 7:
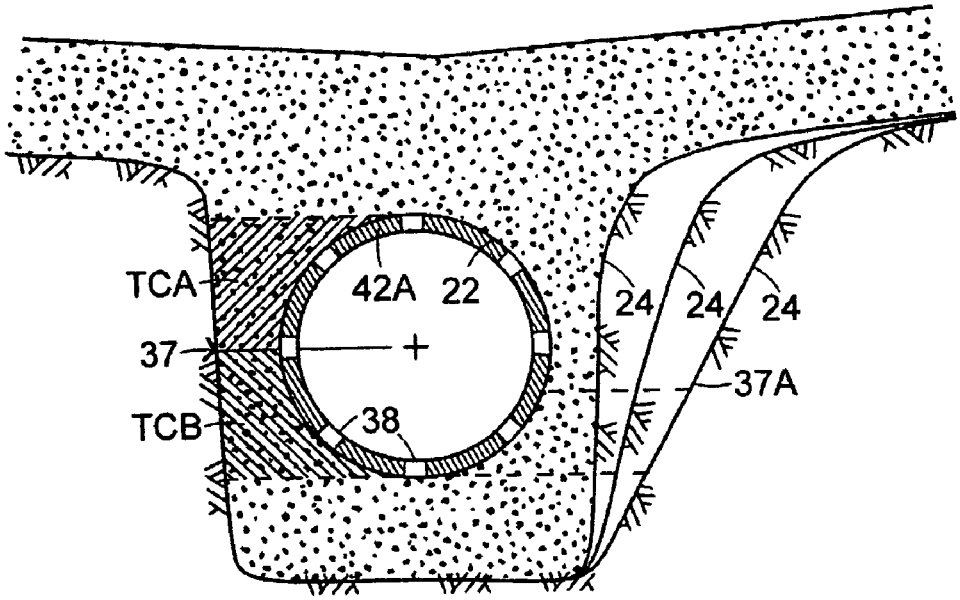
FIG. 7 PRIOR ART
FIG. 7 is analogous to FIG. 7 showing the type of drain used in the prior art.

FIGS. 6 and 7 respectively show further the geometries of the invention and prior art. In FIG. 7, compared to FIG. 1, the trench 24 and round conduit 22A have been scaled up for better visual comparison. (While conduits like the 10 inch conduit represented in FIG. 7 are commercially readily available, their use in bunkers is not known to applicant.) The round conduit has a perforated top 42A. On either side of the round conduit are C-shaped or vaguely hourglass shape zones comprised of upper portion TCA and lower portion TCB. A portion of the water which enters the upper portion TCA may flow vertically downward into openings in the top half of the perforated pipe conduit 22A. From FIG. 7 it will be appreciated that the fraction of water which flows downwardly past the midpoint elevation 37 of the conduit will pass through a narrow horizontal cross sectional area, or pinch point between portions TCA and TCB. And when a water fraction enters lower portion TCB of the zone, the water fraction will into the perforations 38 on the lower side of the conduit. In comparison, reference to FIG. 6 shows how water flowing downwardly passes through no pinch point.

In both Figures, different possible trench sidewall 24 slopes are shown, namely approximately 0, 15 and 30 degrees from the vertical, the latter two being shown in phantom. What the trench wall slope will be depends in part on what is possible in the soil and what the installer wishes to have. With reference to FIG. 7, with a circular conduit, the pinch point effect will be present until the side wall slopes to more than about 30 degrees, as may be visualized. In the preferred drainage system of the invention, the trench sidewalls are essentially vertical. By this is meant that they are sloped less than about 30 degrees from vertical, more preferably less than 15 degrees, most preferably near to 0 degrees. In preferred embodiments of the invention, the dimensions of the chamber and trench will be such that area S will be equal or greater than area T when the trench sidewalls are essentially vertical and the chamber sidewall 44 slopes inwardly at about 15 degrees. When the chamber has a steeper slope sidewall, the relation of S to T will be made larger for any given shape trench.

Thus, in these preferred embodiments, with a chamber having a solid or unperforated top, all the water must flow vertically downwardly to enter the chamber. Thus, all water must flow through area T. Given the relationship of T and S, for a given water flow, when S is greater than T and water runs into the top of the trench and then vertically down, the average velocity sideways through area S will be less than the average vertical velocity through the area T.

Of course for the chamber, the open area of the sidewall is less than the area S due to the dimension and masking effect of the ends of the louvers of the sidewall. Typically, the side wall area of an exemplary chamber is about 75 percent open area, where total exterior surface slot opening area is compared to the total perforated sidewall surface area of a chamber. Of course, the exemplary chamber sidewall has an advantageous meandering or Sidewinder™ pattern of perforated sidewall—where the perforations run along the webs interconnecting the peaks and valleys, as well as along the peaks and valleys themselves, as described in the aforementioned U.S. Pat. No. 5,511,903. Thus when the amount of open area (about 206 square inches per linear foot for the two opposing sidewalls) is compared to the projected area per linear foot of the sidewall area, i.e., as such projected area was considered in the discussion about area S above, then the percent open area is about 90 percent. An exemplary Quickplay chamber will have a calculated sidewall open area, at the exterior where the sand is contacted, of about 180 square inch per linear foot of conduit ($in^2$/LF). In comparison a 4 inch perforated pipe will have 2–3 $in^2$/LF, and a corrugated geotextile wound ten inch conduit will have about 158 $in^2$/LF. The bottom of an exemplary chamber will comprise about 168 $in^2$/LF. When the chamber rests on the bottom of the trench that area would be considered for discharge, not inflow of water. When the chamber rests on a bed of sand, in accord with FIG. 4, some or all of the bottom might contribute to inflow area.

Larger conduit inflow areas are better because they will be associated with lower average flow velocities and or greater life for a given rate of accumulation of geotextile- or sand-clogging substances in water. Where there are high velocities there is more tendency for entrainment of fine particles and there is more resistance to water flow. Thus, in the invention there is a favorable relationship of average velocities, toward reducing velocity as the water approaches the chamber.

Obviously, when the total water flow into the trench is low, the predominant flow into the chamber may be through the slots at the bottom of the chamber sidewall, as the water flows downwardly first, before flowing sideways. While there may be some water flow outwardly into the soil through the trench walls 24, generally a drainage system is used because the soil has poor, or at least insufficient, permeability. So, despite the variables, the essential beneficial effect of the essential geometry obtains in most applications.

The invention system has the feature that the sand which is placed into the trapezoid cross section adjacent the chamber conduit will fill the space better and more surely than when a round conduit is used. With the aforementioned pinch point, when sand is poured around the round conduit there will be less tendency for good filling compared to the arch shape chamber. When coarser media than the aforementioned USGA type bunker sand is used to surround the conduit, then the effect can be aggravated. When there is not good fill, then the system can be dimensionally unstable when first installed. That means that drainage pitches which are intended for the system will not be assured.

Another feature of the chamber compared to round conduit resides in the way in which vertical loads are carried, and how the soil at the bottom of the trench is comparatively uncompressed. While the load due to mass of sand above the chamber or conduit may be viewed as being modest, the drainage system must be capable of bearing weight of people and maintenance machinery. Particularly when it is made of plastic, the conduit or chamber must resist time dependent deformation or failure due to creep or stress rupture. While round conduits are commonly capable of bearing the requisite loads, they do this is part because of the resistive force of the surrounding sand, gravel, or other media on the bottom (and sides) of the conduit.

Thus, as a corollary, with round conduits there is a vertical compressive force on the sand or other media in the trench, and on the soil which forms the bottom of the trench. If such soil has a permeability that is useful in dissipating water, compressing it is not helpful. In the invention, the chamber sidewalls carry the vertical load to their lower ends and typical flanges. They do compress the soil locally, but the soil in the center area of the trench is not compressed, and as a generality, uncompressed soil will have better permeability than compressed soil.

Another feature of the invention, compared to the prior art, is that the bottom of the trench being open, is not masked by the presence of sand or stone and therefore infiltration into the soil by water entering the chamber will be better. Common practice is to consider that where stone, sand, or other impermeable media contact a trench bottom or sidewall, that the area contacted is not available for infiltration of water into the soil. So, in the prior art, when sand or other granular media rests on the bottom of the trench there is a masking; and in the invention, there is none, except when the FIG. 4 embodiment is used, or to an extent for the embodiment of FIGS. 8 and 9.

The optional use of geotextile can be assumed in all the Figures herein unless expressly excluded. Whether a filter fabric is necessary to prevent excess flow of particles through the perforations depends on the sizing and shaping of the perforations in the sidewall, the characteristics of the sand, e.g., particle size, shape and cohesiveness of the particles, and the water flow.

While sidewalls can be conceived as having perforations which are shaped and sized to inhibit significant inflow of grains of sand, within the present technology and economics, the perforations are such that use of a filter fabric or geotextile to cover the perforations is indicated. A filter fabric or geotextile is typically a non-woven or felted fabric. Woven fabrics may also be used. The geotextile is typically comprised of plastic fibers, such as polypropylene. An exemplary material is MIRAFI 160N Polypropylene Geotextile (T. C. Mirafi, Inc. Pendergrass, Ga.). The material has an apparent opening size of 0.212 mm, a permittivity of 1.4 $sec^{-1}$, and a flow rate of 4477 $l/min/m^2$ (determined respectively by ASTM D4751, D4491, and D4491). Other grades of MIRAFI geotextiles will be useful, according to the sand which is used. And of course, commercially competitive products may be used.

In one embodiment, strips of geotextile are first laid along the perforated portions of the sidewall and then sand is put in the trench. In another embodiment a sheet of geotextile is more conveniently first laid over the top and sidewalls, as shown in FIG. 4. In still another embodiment, the trench 36 is first lined with a layer of geotextile which runs down one wall and up the other, with surplus, and then the chamber 40 is placed within the trench to lie on the fabric, as shown in the perspective view of FIG. 8. Then the layer 60 of geotextile is folded over the chamber, so the ends of the layer overlap across the top of the chamber, as illustrated in the vertical cross section view of FIG. 9. Next, the trench is filled with sand.

Figure 8:
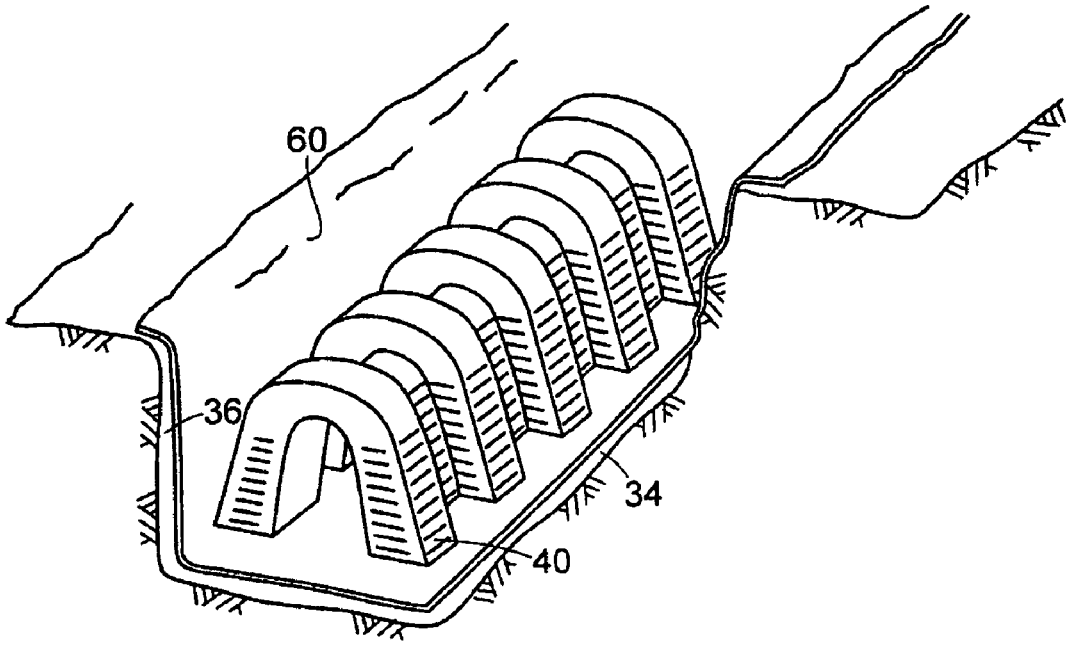
FIG. 8 is a top perspective view of chambers being installed with a geotextile wrap, in a trench.
Figure 9:
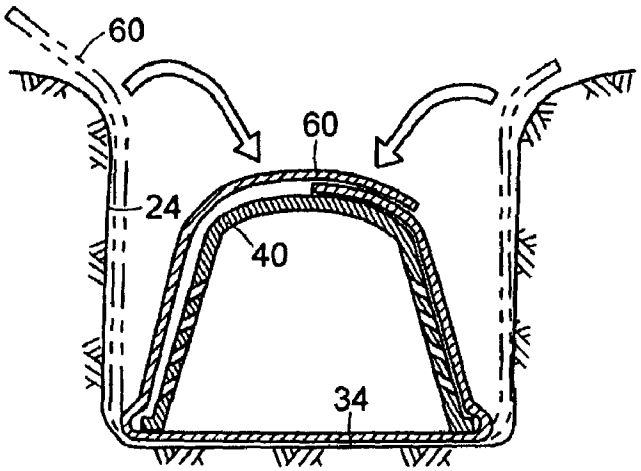
FIG. 9 is an end view showing the wrapping stage relating to FIG. 8.
Figure 10:
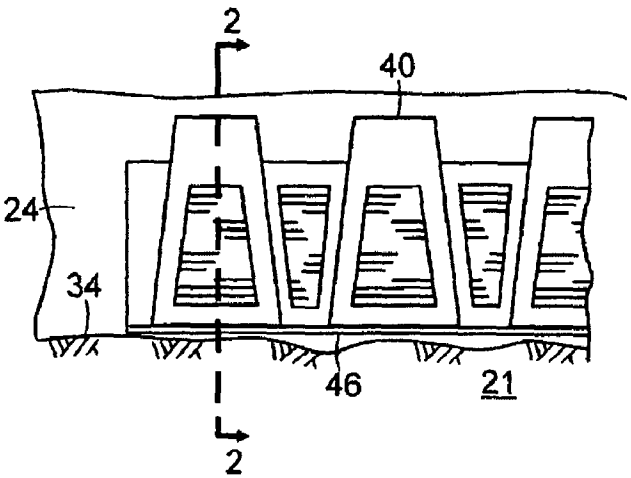
FIG. 10 is a side elevation view of a chamber in a trench, showing the uneven trench bottom and the peaks and valleys of a chamber.

In the embodiment of FIGS. 8–9, the geotextile has a further function which is different from its purpose of inhibiting sand from entering the side walls. The geotextile compensates for the uneven-ness of the sand or soil at the bottom of the trench and possible flow of sand there into the chamber. FIG. 10 shows a portion of a chamber 40 in lengthwise elevation view, as it sits within the length of the trench 36. The surface 34 of the soil 21 on which the chamber sits will typically have a degree of unevenness, as exaggerated in the illustration of FIG. 10. Thus, the base 46 of the chamber will rest on the high points or peaks of the surface 34 and there will be spaces between the chamber bottom and the valleys of the surface 34. Although thin, the geotextile is compressed at the peaks, and is comparatively uncompressed in the valleys. Both the filtering and compressed gasket-like aspects of the geotextile at the base region hinder the movement of sand into the chamber by passage under the base. So, in the generality of this aspect of the invention, the fabric need not run up the sidewalls, but it may run from the lower portion of one sidewall, under the opposing bases by crossing the bottom of the chamber interior, and up the lower portion of the opposing side wall.

Water which is received by the drainage system must ultimately be disposed of. In some installations, the permeability of the soil is such that all the water collected in the chamber will, with the passage of time percolate down or sideways into the soil forming the trench. In such instances no discharge point is required. In other installations, a string of connected chambers is sloped along its length, so that the water flows downwardly to a discharge point and no water accumulates in the chambers. The discharge point may be a penetration of a chamber to the surface of the soil, for instance as a penetration though a hillside upon which the bunker is formed, or it may be a subterranean sump from which the water is periodically pumped for use, such as for irrigation.

Figure 11:
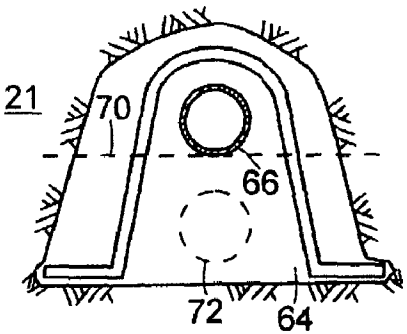
FIG. 11 is an end elevation view of a chamber conduit in a trench having an endplate and containing water.
Figure 12:
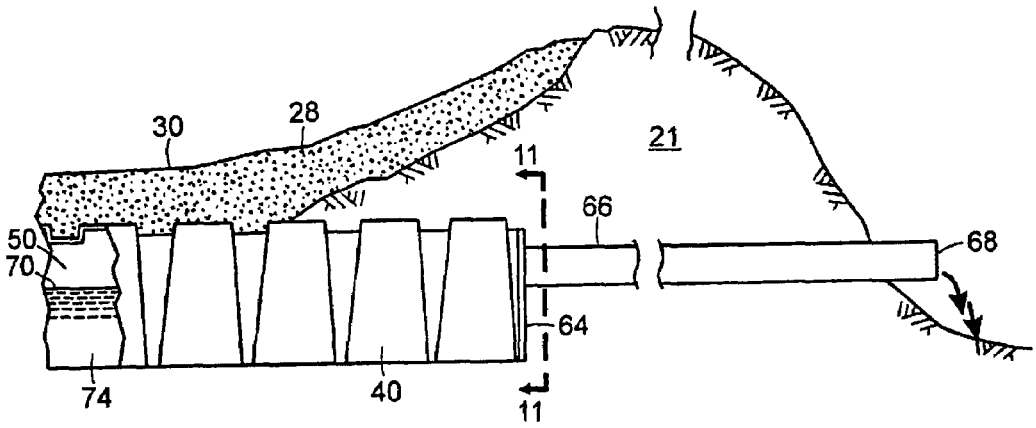
FIG. 12 is a side elevation view of the chamber conduit shown in FIG. 11.

It is often desirable to employ a combination of storage and discharge, while making the discharge unobtrusive. One way in which this is done is shown in the end and side elevation views of FIGS. 11 and 12. The end of the chamber which is at the end of the string of chambers, which are laid level, is closed off by endplate 64 which has an opening into which is fitted discharge pipe 66. Thus, water 74 accumulates in the chamber a level 70 which is determined by the invert elevation (i.e., the lowest point of the passageway for water) in the opening of the endplate 64, after which additional water entering the system will flow down the pipe 66 to end 68 where it is discharged to the surface of the surrounding soil, as indicated by the arrows in FIG. 12. The endplate 64 typically has molded cutouts 72 as illustrated in FIG. 11, so that the invert level can be chosen in the field. See U.S. Pat. No. 5,839,844 for various endplate constructions. Compared to J-traps in discharge lines, which might alternately be used, the system employing the endplate has little propensity for clogging due to debris in the water flow.

Thus, in the invention, when the water flow is more than can percolate into the soil of the trench during the time of inflow, a portion of the water is retained in the chamber, for later percolation, while a (excess) portion of water is discharged to the outside surface. In the exemplary Quickplay 46 chamber which is about 100 inches long, a chamber with an endplate having the maximum invert elevation will be near the top of the chamber, and each chamber will hold 30 or more gallons. Additional water will be stored within the interstices of the sand or other media in the trench. In the foregoing arrangement the large volume of the interior 50 of the chamber also acts as a settling basin. So, when any sand is carried into the chamber with the incoming water, it desirably settles out in the low velocity flow condition which obtains within the chamber.

The invention also has favorable storage characteristics compared to prior art systems. The total storage volume per linear foot is the sum of the water which can be stored in the trench and the water which can be stored in the surrounding granular material. For the same size of 12 inch deep by 18 inch wide trench filled with bunker sand, which has about 22 percent porosity, the approximate storage volumes in cubic inches per linear foot of trench is as follows: For the Quickplay 46: 1,310. For a 4 inch perforated pipe: 708. For a 4 inch perforated pipe surrounded by a layer of foam pellets to a 10 inch diameter: 780.

Figure 13:
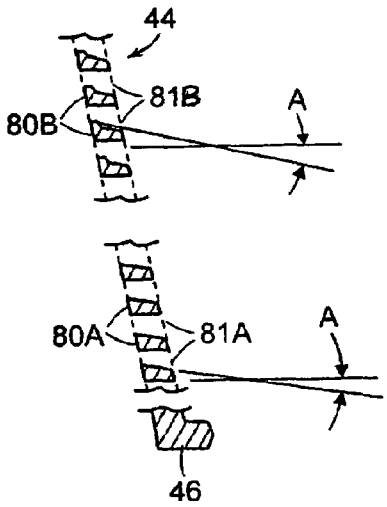
FIG. 13 is a end cross section view through a sidewall of a chamber showing two different configurations of louvers and their associated slots perforations.

As shown in fragmentary sidewall cross section of FIG. 13, the sidewall of the chamber is preferably comprised of louvers 80A or louvers 80B which define the slotted perforations 81A and 81B. The louvers 80A have a wedge shape cross section and the angle A from horizontal of the top slope is about 15 degrees. The louvers 80B have an L-shape cross section, and define effectively an upper surface angle of 15 degrees also. Louvers of type 80B or 80A would typically be used uniformly on any given chamber. The shape and spacing of the louvers forces horizontal flow of the water entering the chamber, but they do not force upward flow of all the water.

Figure 14:
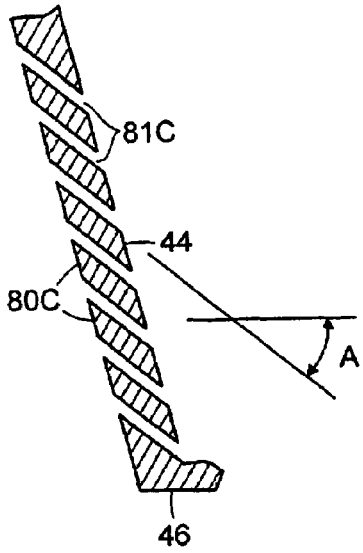
FIG. 14 is like FIG. 13, showing another configuration louvers and slots.

FIG. 14 shows another sidewall configuration which conceptually may be used although manufacturing feasibility is difficult. The louvers 80C slope downwardly at about 40 degrees from horizontal. Thus, slots 81C are longer in length and require vertical up flow of water into the chamber. That upward path will further inhibit sand from entering with the water or by gravity. Thus, depending on the sand and water flows the system experiences, the side wall type shown in FIG. 14 will tend toward elimination of the need for geotextile.

Figure 15:
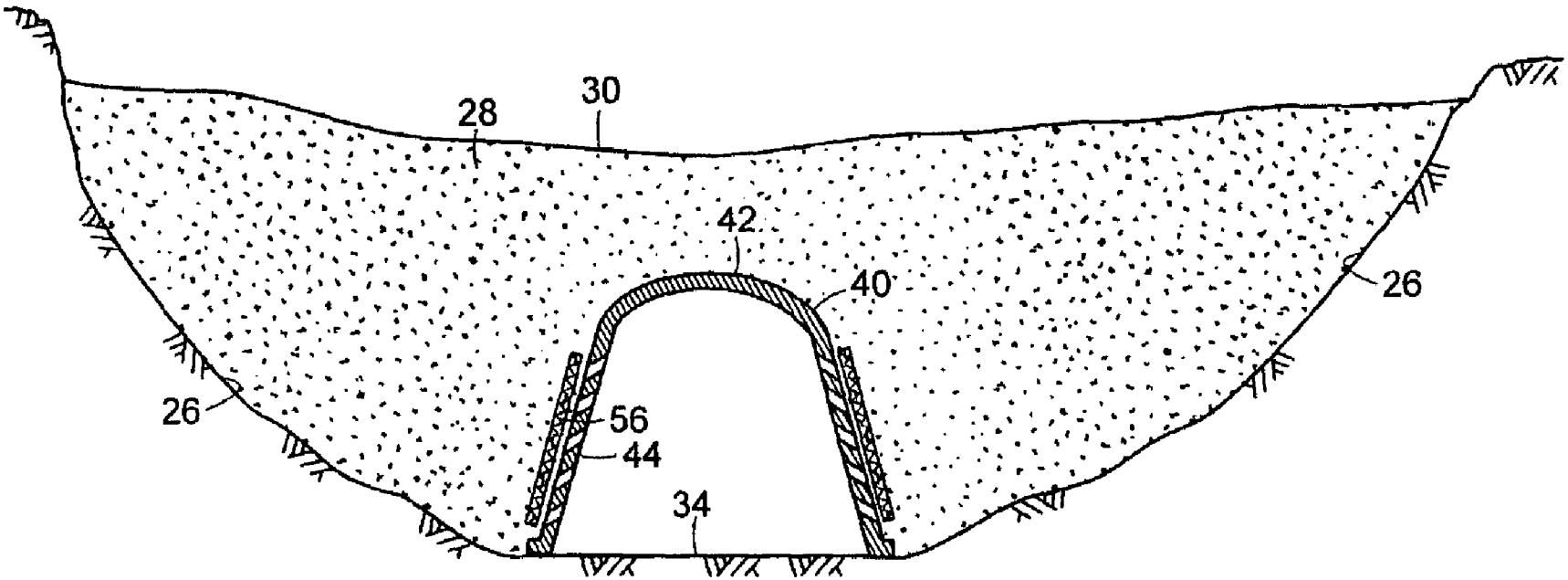
FIG. 15 is an elevation cross section view through a bunker showing a drainage system comprising a chamber running along the bottom of the bunker.

FIG. 15 shows another embodiment of the invention, wherein the drainage system comprises a chamber 40 which is not contained within a trench. The chamber runs along the bottom of the depression 26 which defines the bunker bottom. The chamber in FIG. 15 has sidewalls with only the lower part perforated; and, geotextile 56 is shown in place along such lower part. Thus, inadvertent contact of a bunker rake or the like with the upper portion of the chamber conduit will not cause failure of the geotextile protection over openings into the conduit.

While in the preferred embodiment the granular material which surrounds the chamber is sand, in the generality of the invention other materials can be placed around the chamber. For instance, gravel and stone and sand, along or as mixtures, can be used. When sand is being drained, progressively larger particle size materials, such as a progression from gravel to pea stone to larger stone can sometimes be employed, to eliminate the use of geotextile, depending on the sand. In another alternative, granular plastic or other organic material can be used.

While the preferred conduit of the invention is an arch shape conduit having alternating peaks and valleys, in the generality of the invention, conduits which have arch shapes but not peaks and valleys may be used.

The drainage system invention has been described in terms of a golf course bunker, which is the present application of most interest. However, the system is applicable to other features of a golf course and applications other than golf courses. For instance, the invention drainage system can be employed in substitution of other trench drainage systems. The invention drainage system can be used for draining other accumulations of granular materials, such as piles of coal, natural minerals, artificial substances, etc., and in this context the term sand in the claims should be taken so as to comprehend such.

The invention provides improved storage capacity for any given trench. The absence of perforations at the top of the conduit, and their confinement to the sidewalls, means there is less stress of bunker sand on the geotextile when it is used to cover perforations. So, there is less tendency for the filter fabric to fail and less flow of sand into the interior if there is a failure. The greater surface area of openings and less average velocity of water into the conduit mean that there will be less entrainment of fines which can clog the openings into the chamber, and more capacity to absorb an given amount of fines of contaminant.

Although this invention has been shown and described with respect to a preferred embodiment, it will be understood by those skilled in this art that various changes in form and detail thereof may be made without departing from the spirit and scope of the claimed invention.

I claim:

1. A drainage system for a sand bunker which comprises a depression in soil filled with bunker sand, comprising: at least one conduit, running along the bottom of the depression, for receiving water flowing into the bunker sand; the conduit having (a) an arch shape cross section, (b) a solid top with respect to passage of water therethrough, and (c) opposing side walls having downward sloped perforations, the sidewalls running downwardly and outwardly from the top to opposing sidewall bases; wherein, said conduit has an open bottom; and, wherein a vertical load applied to the top of the conduit is transferred downwardly only to spaced apart portions of said bases, to thereby leave free of vertical load the predominant portion of the soil which forms the bottom of the depression underlying said at least one conduit.

2. The system of claim 1, further comprising geotextile filter fabric running over the perforations of the sidewalls of the conduit, to inhibit the entry of sand into the perforations of the sidewalls.

3. A drainage system for a sand bunker which comprises: a depression in soil filled with bunker sand; a trench, formed within the soil which is at the bottom of the depression, the trench having a bottom and sidewalls running upwardly therefrom to the bottom of the depression; at least one conduit, for receiving water flowing into the bunker sand; wherein said conduit is positioned within and along said trench; the conduit having (a) an arch shape cross section, (b) a solid top with respect to passage of water therethrough, and (c) opposing side walls having downward sloped perforations, the sidewalls running downwardly and outwardly from the top to opposing sidewall bases; wherein, said conduit has an open bottom; wherein the conduit and trench are shaped so that spaces are formed between the sidewalls of the conduit and the sidewalls of the trench; and, wherein said spaces are filled with sand.

4. The drainage system of claim 3 further comprising an endplate at one end of the conduit, the endplate having an invert connected to a discharge pipe, wherein the invert of the endplate is higher in elevation than the elevation of the bases of the conduit, so that any water which accumulates in the conduit rises to the invert elevation level before flowing from the conduit and through the discharge pipe.

5. The drainage system of claim 4, having a water storage volume of greater than 800 cubic inches per linear foot.

6. A drainage system for a sand bunker constructed in soil which comprises:

at least one arch shape cross section conduit, having a solid top and opposing side walls having downwardly sloped perforations for passage of water, the sidewalls running downwardly and outwardly from the top to opposing side bases;

a trench in the soil having essentially vertical side walls running upward from a trench bottom; wherein, the conduit is contained lengthwise within the trench, with the bases thereof proximate the trench bottom; and, sand, contained within opposing side downwardly and inwardly tapered trapezoidal cross sectional spaces on either side of the length of the conduit, said spaces lying between the opposing side walls of the conduit and the side walls of the trench and extending upwardly from the trench bottom, wherein, said conduit has an open bottom; and, wherein a vertical load applied to the top of the conduit is transferred downwardly only to spaced apart portions of said bases, to thereby leave the predominant portion of the soil which forms the bottom of the trench free of vertical load.

7. The system of claim 6 wherein the conduit base is spaced apart from the bottom of the trench by a layer of sand.

8. The system of claim 6, wherein said conduit has a water storage volume of greater than 800 cubic inches per linear foot.

9. The system of claim 6 wherein, for a unit length of system, each said trapezoidal space has upper horizontal plane surface area T and a generally vertically running surface area S adjacent the perforated portion of the sidewall of the conduit, wherein the area S is greater than the area T.

10. The system of claim 6 wherein the conduit sidewall slopes inwardly 6–15 degrees from vertical and the trench sidewall slopes outwardly 0–30 degrees from vertical.

11. The system of claim 6, further comprising geotextile filter fabric running over the perforations of the sidewalls of the conduit, to inhibit the entry of sand into the perforations of the sidewalls.

12. The drainage system of claim 6 wherein the elevation of the top of the conduit is at or near the elevation of the bottom of the depression.

13. The drainage system of claim 6 further comprising an endplate at one end of the conduit, the endplate having an invert connected to a discharge pipe, wherein the invert of the endplate is higher in elevation than the elevation of the bases of the conduit, so that any water which accumulates in the conduit rises to the invert elevation level before flowing from the conduit and through the discharge pipe.

14. The system of claim 6 wherein the sidewalls of said conduit have perforations sloped downwardly and outwardly, the lengths and slopes of said perforations sufficient to require upward flow of any water which flows into the conduit.

15. A drainage system for a sand bunker constructed on soil which comprises:

a trench in the soil, the trench having a bottom and sidewalls;

at least one arch shape conduit having a hollow interior running along the trench, the conduit having a top and opposing perforated side walls, wherein each sidewall runs downwardly from the top to an opposing sidewall base, and wherein said opposing sidewall bases rest on material at the bottom of the trench;

sand-filled spaces between the sidewalls of the trench and the sidewalls of the conduit; and, a layer of geotextile fabric running downwardly from at least a lower portion of one sidewall and under the base thereof, across the bottom of the trench, under the opposing sidewall base, and upwardly along at least a lower portion of the opposing sidewall, wherein the portion of geotextile fabric which runs under each opposing side base provides a seal, to inhibit sand from running under said bases and into the conduit hollow interior.

16. The system of claim 15 further comprising a layer of sand between the bases of the conduit and the bottom of the trench.

17. A drainage system for a sand bunker constructed on soil which comprises:

a trench in the soil, the trench having a bottom and sidewalls running upwardly therefrom;

at least one arch shape cross section conduit having a top, opposing perforated side walls running downwardly from the top to opposing sidewall bases;

wherein the conduit is contained within the trench, so that there are spaces between the sidewalls of the trench and the sidewalls of the conduit;

permeable granular media contained within the spaces between the side walls of the conduit and the side walls of the trench;

an endplate, at one end of the conduit, having an invert connected to a discharge pipe, wherein the invert of the endplate is higher in elevation than the elevation of the bases of the conduit, so that any water which accumulates in the conduit rises to the invert elevation level before flowing from the conduit and through the discharge pipe.

18. A method of draining water from a sand bunker, which bunker comprises a depression in soil filled with sand, which method comprises: (a) flowing substantially all said water being drained from the sand bunker downwardly past a first upper portion of an arch shape cross section means for receiving water buried within said sand; and (b) then flowing water laterally through a second lower portion of said means and into the interior of said means; wherein, at least a portion of said water flowing into said interior of said means flows downwardly into said soil.

19. The method of claim 18 which further comprises flowing the water into a trench at the bottom of the depression before step (a).

20. The method of claim 18 wherein, during step (b), said water is in addition flowed upwardly through said second portion of said means for receiving water.

21. A method of draining water from a sand bunker, where water flows through the sand of the bunker into a trench running along the bottom of the bunker, which comprises:

providing a trench filled with sand, the trench containing at least one arch shape cross section conduit having a hollow interior, a solid top and opposing perforated sidewalls which run downwardly from the top to opposing sidewall bases, wherein the sidewall bases rest on sand or soil at the bottom of the trench;

flowing substantially all the water which flows to the trench in a vertically downward direction, through opposing side horizontal planes T running from the lowermost portions of the solid part of said top, to thus flow said water to proximity of the conduit sidewalls;

then flowing said water with a horizontal or sideway flow direction component through opposing side upwardly running planes S adjacent to and running along said conduit sidewalls, and, then, flowing said substantially all water through said sidewalls and into the interior of said conduit, wherein a portion of said water flows into the soil at the bottom of the trench.

22. The method of claim 21, further comprising flowing the water though said horizontal planes T with a higher average velocity than the average sideway velocity of water flow through said upwardly running planes S.

23. The method of claim 21, further comprising: flowing water upwardly during the step of flowing said water through said sidewalls and into the conduit.

24. A method of constructing a sand bunker on soil which comprises:

forming within the soil a trench having a bottom and opposing sidewalls running upwardly therefrom;

laying geotextile within the trench, so that the geotextile runs down from a point adjacent one side of the trench, to and down one trench sidewall, across the bottom of the trench, and up the opposing trench sidewall;

placing an arch shape cross section conduit within the trench so the base thereof rests on the geotextile where it runs across the bottom of the trench; the conduit having vertically running sidewalls spaced apart from the sidewalls of the trench;

moving the fabric from where the fabric lies adjacent the opposing sidewalls of the trench, toward the sidewalls of the conduit, so the fabric runs upwardly along the conduit sidewalls, to and across the top of the conduit, to thereby envelope the conduit; and, filling the trench with sand having predominately a grain size incapable of passing through the geotextile.

25. The method of claim 24 further comprising: placing a layer of sand in the trench prior to the step of laying the geotextile in the trench.

* * * * *